US007563478B1

(12) United States Patent
Humphreys et al.

(10) Patent No.: US 7,563,478 B1
(45) **Date of Patent: *Jul. 21, 2009**

(54) SYNTHETIC ROOFING SHINGLES

(75) Inventors: John Humphreys, Mission Hills, KS (US); Jeff Martinique, Edwardsville, KS (US)

(73) Assignee: DaVinci Roofscapes, LLC, Kansas City, KS (US)

( * ) Notice: Subject to any disclaimer, the term of this patent is extended or adjusted under 35 U.S.C. 154(b) by 293 days.

This patent is subject to a terminal disclaimer.

(21) Appl. No.: 11/062,257

(22) Filed: Feb. 17, 2005

Related U.S. Application Data

(63) Continuation of application No. 10/364,563, filed on Feb. 10, 2003, now Pat. No. 7,140,153.

(60) Provisional application No. 60/405,958, filed on Aug. 26, 2002.

(51) Int. Cl.
*B05D 1/24* (2006.01)

(52) U.S. Cl. ..... 427/186; 427/198; 427/195; 427/203; 52/415; 52/741.419

(58) Field of Classification Search ..... 52/173.3, 52/309.3, 415, 741.4; 136/245, 251; 524/44, 524/45, 63; 427/198, 195, 186, 203
See application file for complete search history.

(56) References Cited

U.S. PATENT DOCUMENTS

| | | | | |
|---|---|---|---|---|
| 2,624,298 | A | 1/1953 | Farren | |
| 2,735,143 | A | 2/1956 | Kearns | |
| 2,830,546 | A | 4/1958 | Rippe | |
| 3,060,163 | A | 10/1962 | Erchak, Jr. | |
| 3,269,075 | A | 8/1966 | Cosden | |
| 3,347,001 | A | 10/1967 | Cosden | |
| 3,579,940 | A | 5/1971 | Greenleaf | |
| 3,667,184 | A | 6/1972 | Merrill | |
| 3,852,934 | A | 12/1974 | Kirkhuff | |
| 3,903,340 | A | 9/1975 | Shepherd | |
| 3,983,675 | A | 10/1976 | Pearse | |
| 4,010,590 | A | 3/1977 | Reinke | |
| 4,067,256 | A | 1/1978 | Turner | |
| 4,141,187 | A | 2/1979 | Graves | |
| 4,193,898 | A | 3/1980 | Miller | |
| 4,214,918 | A * | 7/1980 | Gat et al. | 438/618 |
| 4,252,603 | A | 2/1981 | Kharsas et al. | |
| 4,268,572 | A | 5/1981 | Toland | |
| 4,301,633 | A | 11/1981 | Neumann | |
| 4,514,947 | A | 5/1985 | Grail | |
| 4,914,885 | A | 4/1990 | Baker | |
| 5,070,671 | A | 12/1991 | Fitfield | |
| 5,174,092 | A | 12/1992 | Naden | |
| 5,189,083 | A | 2/1993 | Gelles et al. | |
| 5,190,997 | A | 3/1993 | Lindemann et al. | |
| 5,214,082 | A | 5/1993 | Gelles et al. | |
| 5,215,598 | A * | 6/1993 | Kouzuma et al. | 136/251 |

(Continued)

*Primary Examiner*—Richard E Chilcot, Jr.
*Assistant Examiner*—Chi Q Nguyen

(57) ABSTRACT

Disclosed is a coated synthetic shingle that exhibits increased resistance to ultra-violet radiation. The shingle is useable for roofing applications and includes a substrate having a substrate surface and a base coat that is applied to the substrate surface. The base coat preferably includes a first fluoropolymer component. The shingle can also include a top coat that is applied to the base coat. The top coat preferably includes a clear acrylic coating. A method for manufacturing the shingle is also disclosed.

6 Claims, 2 Drawing Sheets

U.S. PATENT DOCUMENTS 5,305,570 A 4/1994 Rodriguez
5,437,735 A 8/1995 Younan et al.
5,502,940 A 4/1996 Fitfield
5,528,872 A 6/1996 Rotter
5,575,861 A * 11/1996 Younan et al. ..... 136/251
5,603,758 A 2/1997 Schreifels, Jr. et al.
5,613,337 A 3/1997 Plath
5,615,523 A 4/1997 Wells et al.
5,644,886 A 7/1997 Ekmark
5,711,126 A 1/1998 Wells
5,784,848 A 7/1998 Toscano
5,902,683 A 5/1999 Sieloff
5,974,756 A 11/1999 Alvarez
6,070,384 A 6/2000 Chich
6,120,913 A 9/2000 Kluttz et al.
6,178,703 B1 1/2001 Noone
6,180,871 B1 * 1/2001 Campbell et al. ..... 136/258
6,194,519 B1 2/2001 Blalock et al.
6,233,895 B1 5/2001 Evans
6,282,858 B1 9/2001 Swick
6,415,562 B1 7/2002 Donaghue
6,418,692 B1 7/2002 Freshwater
6,530,189 B2 3/2003 Freshwater
6,540,829 B2 4/2003 Allman et al.
RE38,210 E 8/2003 Plath
6,619,006 B1 9/2003 Shirota
6,679,308 B2 1/2004 Becker
6,715,252 B2 4/2004 Stahl
6,729,081 B2 5/2004 Nath et al.
6,758,019 B2 7/2004 Kalkanoglu
6,808,785 B1 10/2004 Friedman
6,907,702 B2 6/2005 Gilbert
7,003,922 B2 2/2006 Fitfield
7,118,794 B2 10/2006 Kalkanoglu
7,125,601 B1 * 10/2006 Pinault et al. ..... 428/143
7,155,866 B2 1/2007 Bezubic, Jr. et al.
7,241,500 B2 7/2007 Shiao
2002/0189188 A1 12/2002 Iole
2006/0260731 A1 11/2006 Kalkanoglu
2007/0107356 A1 5/2007 Steffes
2008/0028705 A1 2/2008 Morse

* cited by examiner

SYNTHETIC ROOFING SHINGLES

RELATED APPLICATIONS

This application is a continuation of U.S. patent application Ser. No. 10/364,563 filed Feb. 10, 2003 is now U.S. Pat. No. 7,140,153, and U.S. Provisional Patent Application Ser. No. 60/405,958 filed Aug. 26, 2002, which are hereby incorporated herein by reference.

FIELD OF THE INVENTION

The present invention is generally related to improved building materials and more particularly related to synthetic shingles useable in roofing applications.

BACKGROUND OF THE INVENTION

Shingles are typically small, thin sheets of building material that are used in overlapping rows to protect the interior of a house from inclement weather. Historically, shingles have been constructed from a number of compositions, including natural slate, metal, fibrous cement, ceramics, wood, concrete and bitumen compounds.

In recent years, synthetic shingles have gained favor in the steep-slope roofing industry. Synthetic shingles are advantageous over conventional shingles because they do not absorb water, can be manufactured in virtually any shape, size and style, are strong and lightweight, and provide a total installed roofing cost that is substantially less costly than that of slate shingles. Furthermore, synthetic shingles can be made with increased fire retardancy and increased impact resistance, both of which are significant advantages over wood shakes and wood shingles.

Typically, synthetic shingles are made from combinations of resin, fillers and color concentrates. Although a number of different polymers have been used, synthetic shingles are most commonly constructed from polyolefin resins. Commonly selected resins may range from polyethylene to polypropylene-type structures.

Although initially effective, insufficient durability and longevity of prior art synthetic shingles have limited their popularity in the marketplace. The limited lifespan of existing synthetic shingles largely results from extended exposure to the sun's intense ultraviolet (UV) radiation, which degrades the molecular structure of typical synthetic shingles, causing the shingle to embrittle, fade or deform.

In an attempt to combat UV degradation, synthetic shingle manufacturers have added UV-resistant fillers (also referred to as "additives") to the underlying plastic resin mixture. Other manufacturers have built color concentrates into their resins that include UV inhibitors, antioxidants and other chemicals that discourage the pigment from changing hue over time. These additives and color concentrates are new in the marketplace, and their long-term effectiveness is unproven.

Despite the limited advances in the industry, there continues to exist a need for an improved synthetic shingle that overcomes the inherent vulnerabilities of prior art synthetic shingles.

SUMMARY OF THE INVENTION

The present invention includes a coated synthetic shingle that exhibits increased resistance to ultra-violet radiation. The shingle is useable for roofing applications and includes a substrate that has a base coat applied to the substrate surface.

The base coat preferably includes a fluoropolymer component. In alternate embodiments of the present invention, the shingle also includes a top coat that is applied to the base coat. The top coat preferably includes a clear acrylic coating.

DETAILED DESCRIPTION OF THE PREFERRED EMBODIMENT

Figure 1:
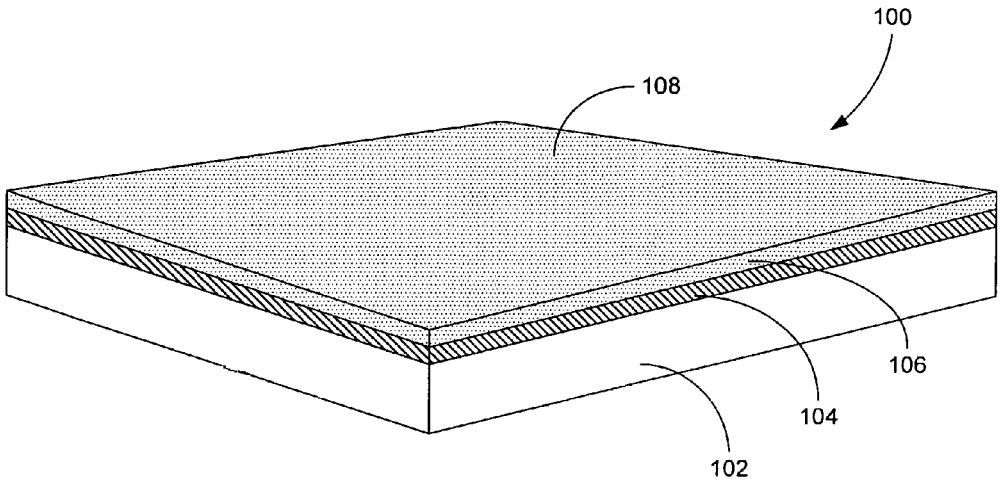
FIG. 1 is a perspective view of a cross-sectional of a portion of a coated synthetic shingle constructed in accordance with a presently preferred embodiment of the present invention.

Turning first to FIG. 1, shown therein is a perspective view of a cross-section of a portion of a synthetic shingle 100 constructed in accordance with a preferred embodiment of the present invention. The shingle 100 generally includes a substrate layer 102, a base coat 104 and a top coat 106. It will be understood that the depiction of the integral layers in FIG. 1 is merely exemplary and that proportions may be exaggerated for clarity. For reference, the substrate layer 102, base coat 104 and top coat 106 each include an upper surface and a lower surface (not separately designated). For example, the upper surface of the substrate layer 102 is adjacent the lower surface of the base coat 104.

The substrate 102 is constructed from a plastic that exhibits suitable flexibility and resilience. The flexibility and resilience of the substrate 102 should be selected to enable the use of nails or staples during the installation of the shingle 100. In a preferred embodiment, the substrate 102 is fabricated from a blend of one or more plastics, such as PE (polyethylene) or PPE (polypropylene). In particularly preferred embodiments, the substrate 102 includes a blend of low and high molecular weight polyethylene resins.

The substrate 102 can also include fire retardants, such as magnesium hydroxide. Fiberglass fibers can also be added to the substrate 102 to further enhance fire retardance and to improve durability and resistance to tearing. Antioxidants can be included in the substrate 102 to limit the aging effects caused by UV radiation. The use of fire retardants, fiberglass fillers and antioxidants as additives in plastics is generally known in the art.

In the presently preferred embodiment, the substrate 102 also includes a "base-gray" color concentrate. It will be noted, however, that alternative color concentrates, dyes or pigments can be employed to adjust the color of the substrate 102. Although not essential to the present invention, injection molding and extrusion techniques may provide acceptable methods of manufacturing the substrate 102.

The base coat 104 preferably includes a colored acrylic coating and more preferably includes a blend of a colored acrylic coating and fluoropolymer components. A preferred colored acrylic coating is available from Strathmore Products, Inc. of Syracuse, N.Y., under the PLASTICEL COATING trademark. The preferred colored acrylic coating includes a selected color concentrate and a mixture of volatile ingredients, such as xylenes, toluene and ethylbenzene.

Suitable fluoropolymers include PTFE (polytetrafluoroethylene) and FEVE (fluorinated ethylene vinyl ether). FEVE is particularly preferred and available from the Asahi Glass Company of Tokyo, Japan under the LUMIFLON trademark.

PTFE is commercially available from the DuPont Company of Wilmington, Del. under the TEFLON trademark. In particularly preferred embodiments, the base coat 104 includes about 25% of fluoropolymer by volume. The acrylic coating and fluoropolymer can be mixed together in bulk during application to the substrate 102.

The base coat 104 protects the substrate 102 from UV degradation. Unlike prior art synthetic shingles that rely on UV-resistant fillers mixed into the substrate 102, the unique formulation of the base coat 104 significantly enhances the durability of the shingle 100 and improves resistance to color-fade. To maximize protection of the substrate 102, the base coat 104 can be applied to the exposed top surface and three side edges of the substrate 102.

In the presently preferred embodiment, the base coat 104 is also used to control the external appearance of the shingle 100. To enhance the appearance of the shingle 100, the base coat 104 and substrate 102 can be sanded or "scuffed" once applied to the underlying substrate 102. Scuffing the base coat 104 and substrate 102 textures the upper surface of the base coat 104 to add depth and a "stone-like" appearance to the shingle 100. As an alternative to scuffing, the base coat 104 and substrate 102 can be painted through a conventional masking process with stencils and pigments.

Pigmented coatings, generally, and fluoropolymers, specifically, do not typically adhere well to polyethylene substrates. To ensure the proper adhesion and integration of the base coat 104 into the substrate 102, a primer can be used to prepare the coated surface of the substrate 102. The primer etches or irritates the surfaces of the substrate 102 to improve the contact between the base coat 104 and the substrate 102. A presently preferred primer is commercially available from Strathmore Products, Inc. under the DRIQUIK CLEAR POLYETHYLENE PRIMER trademark. The preferred primer includes a number of volatile components, such as toluene, xylenes and ethylbenzene, which are preferably removed or allowed to evaporate from the surface of the substrate 102 before application of the base coat 104.

In a presently preferred embodiment, the base coat 104 is protected with the top coat 106. The top coat 106 preferably includes a clear acrylic coating, and more preferably includes a clear acrylic coating and fluoropolymer components. The preferred clear acrylic coating is available from Strathmore Products, Inc. under the PLASTICEL CLEAR 3° ROOF COATING trademark. For the fluoropolymer component, FEVE is preferred and available from the Asahi Glass Company under the LUMIFLON trademark. The top coat 106 improves the UV and impact resistance of the shingle 100. In a particularly preferred embodiment, the top coat 106 includes about 25% by volume fluoropolymer.

In a particularly preferred embodiment, the top coat 106 also includes "grit" or particulate solids 108, that both improves the traction offered by the shingle 100 and has the effect of reducing the reflective gloss of the finished shingle 100. Suitable grit 108 is available as micronized polypropylene under the PROPYLTEX trademark from Micro Powders, Inc. of Tarrytown, N.Y. Although grain sizes of 50-500 microns are available and suitable for use pursuant to the present invention, grit 108 having an average size of about 300 microns is presently preferred. The grit 108 can be added to the acrylic coating and fluoropolymer component and suspended in the application device through periodic or continuous agitation.

Although preferred, it will be understood that the top coat 106 is not required for successful practice of the present invention. In certain applications, it may be desirable to forego the use of the top coat 104. In such applications, the base coat 104 can be impregnated with grit 108 to improve the traction provided by the shingle 100 and reduce reflective gloss. In alternate preferred embodiments, the shingle 100 includes the top coat 106 and the base coat 104, but only the top coat 106 is provided with a fluoropolymer component. In yet another alternate embodiment, the shingle 100 includes both the base coat 104 and the top coat 106, but only the base coat 104 is provided with a fluoropolymer component. As such, the top coat 106 primarily serves to improve impact resistance and traction while reducing reflective gloss.

Figure 2:
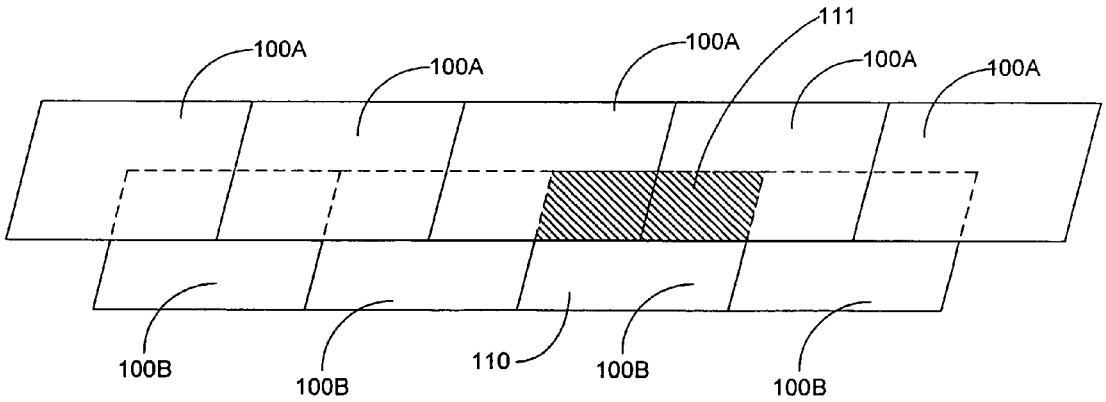
FIG. 2 is a perspective view of two rows of shingles of the type depicted in FIG. 1.

The base coat 104 and top coat 106 are preferably applied to each exposed surface of the substrate 102. It will be understood, however, that partial coating of the substrate 102 may be desired in certain applications. As illustrated by FIG. 2, a bottom row of shingles 100B is partially covered by a top row of shingles 100A. Depending on the amount of overlap between the top and bottom row shingles 100A, 100B, respectively, each bottom row shingle 100B includes an exposed portion 110 and concealed portion 111 (illustrated by cross-hatching). Accordingly, only the exposed portions 110 of the shingles 100 are subject to direct UV-radiation. To save costs on materials during manufacture, it may be desirable to coat only the exposed portions 110 of the shingle 100.

Figure 3:
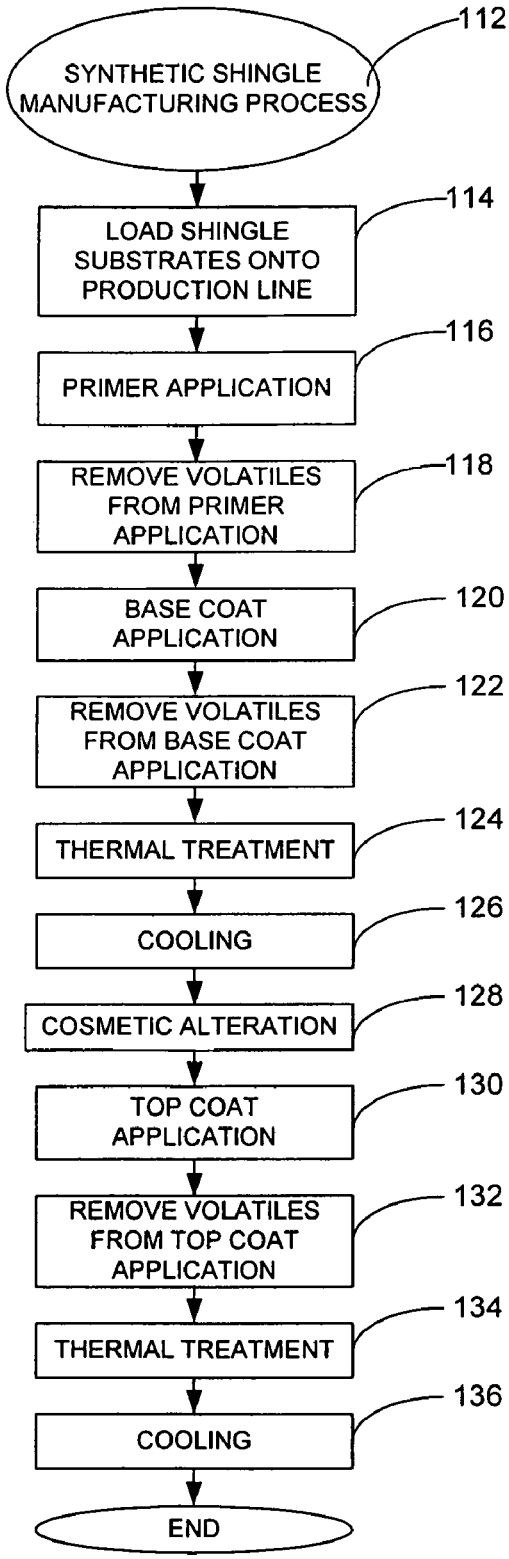
FIG. 3 is a process flow diagram illustrating a presently preferred embodiment of a method for manufacturing the shingle of FIG. 1.

The shingles 100 are presently produced through a manufacturing process 112 illustrated by the flowchart in FIG. 3. Although the production line of the manufacturing process 112 is preferably motorized and automated with controls, it will be understood that the manufacturing process 112 could also be performed through manual execution of each of the following steps. As used herein, the term "piece" refers generally to the shingle 100 and its integral components during the various stages of the manufacturing process 112.

At the beginning of the manufacturing process 112, the prefabricated substrates 102 are loaded onto a conveyor-driven production line at step 114. Preferably, the substrates 102 are packaged or stored in such a way that permits automated loading onto the conveyor system.

Next, at step 116, the primer is applied to the substrate. Preferably, the primer is applied through use of a spray booth through which the moving conveyor carries the substrates 102. As the substrates 102 pass through the primer spray booth, the exposed surface of each substrate 102 is wetted with primer.

At step 118, the primed substrates 102 pass through a first flash vent where the volatile components of the primer are removed from the substrates 102. The first flash vent preferably includes a forced air convection mechanism that expedites the evaporation of the volatile components from the substrate 102. The volatile components are then vented in gaseous form to a suitable recovery or disposal system.

At step 120, the pretreated, substantially dry substrates 102 are carried through a first spray booth for application of the base coat 104. The base coat 104 is preferably sprayed or poured onto the primed surface of the substrate 102. The volatile components in the base coat 104 are removed from the substrate 102 in a second flash vent at step 122 in a manner similar to the removal of volatile components at step 118.

Next, at step 124, the base coat 104 is cured onto the substrate 102 with a suitable curing technique. In the presently preferred embodiment, the curing process takes place in a tunnel oven that heats the substrate 102 and base coat 104 to from about 150° F. to about 160° F. In an alternate embodiment, the substrate 102 and base coat 104 are cured through use of an electron beam curing apparatus. In yet another alternate embodiment, the substrate 102 and base coat 104 are cured using ultraviolet radiation techniques. The cured substrate 102 and base coat 104 are cooled to from about 70° F. to about 90° F. at step 126.

The cosmetic alteration of the substrate 102 and base coat 104 is undertaken at step 128. In the presently preferred embodiment, the upper surface of the base coat 104 is scuffed with wire mesh or sandpaper to add a stone-like appearance to the finished product. As an alternative, a masking process can be used alone or in combination with the scuffing process to adjust the appearance of the finished product.

Upon completion of the cosmetic alteration, the pieces are conveyed into a second paint booth where the top coat 106 is applied to the base coat 104. Because the top coat 106 preferably includes grit 108, the top coat 106 can be stored prior to application in a container that provides periodic or continuous agitation. The volatile components of the top coat 106 are removed in a third flash vent at step 132 in a manner similar to the removal of volatile components at steps 118 and 112.

Next, at step 134, the top coat 106 is cured through a suitable curing technique. In a preferred embodiment, the top coat 106 is cured as the pieces are conveyed through a second tunnel oven. The second tunnel oven heats the pieces to from about 150° F. to about 160° F. Like the base coat 104, the top coat 106 can also be cured through use of alternate methods, such as the electron beam and UV radiation techniques. Once the top coat 106 has been cured to the base coat 104, the manufacturing process 112 concludes as the finished shingles 100 are cooled to from about 70° F. to about 90° F. at step 136.

Although the manufacturing process 112 is presently preferred, there are alternative methods for producing the shingle 100. For example, the base coat 104 and top coat 106 can be applied after the substrate 102 has been installed onto a roof. In this alternative method, the primer, base coat 104 and top coat 106 are painted or sprayed onto the exposed surfaces 110 of the substrate 102. In another alternate embodiment, the grit 108 can be applied to the top coat 106 as it cures. This embodiment alleviates problems associated with moving particulate matter through pressure-driven spray devices.

It is clear that the present invention is well adapted to carry out its objectives and attain the ends and advantages mentioned above as well as those inherent therein. While presently preferred embodiments of the invention have been described in varying detail for purposes of disclosure, it will be understood that numerous changes may be made which will readily suggest themselves to those skilled in the art and which are encompassed within the spirit of the invention disclosed herein, in the associated drawings and appended claims.

The invention claimed is:

1. A method for manufacturing a coated synthetic shingle, the method comprising:

(a) providing a substrate comprising a blend of low molecular weight and high molecular weight polyethylene resins;

(b) applying a primer to the substrate to provide a primed substrate;

(c) applying a base coat to the primed substrate, wherein the base coat comprises a first fluropolymer component and a plurality of particulate solids; and (d) applying a top coat to the base coat, wherein the top coat comprises a clear acrylic coating and a second fluropolymer component.

2. The method of claim 1, wherein the base coat further comprises a clear acrylic coating.

3. The method of claim 1, wherein the first fluoropolymer component is fluorinated ethylene vinyl ether.

4. The method of claim 1, wherein the fluoropolymer component is fluorinated ethylene vinyl ether.

5. A method for manufacturing a shingle suitable for roofing application, the method comprising: (a) providing a substrate comprising a blend of low molecular weight and high molecular weight polyethylene resins; (b) applying a primer to the substrate to provide a primed substrate; (c) applying a base coat to the primed substrate, wherein the base coat comprises a first fluoropolymer component; and (d) applying a top coat to the base coat, wherein the top coat comprises a clear acrylic coating and a second fluoropolymer component.

6. A shingle useable for roofing applications, wherein the shingle is produced by a process comprising: (a) providing a substrate comprising a blend of low molecular weight and high molecular weight polyethylene resins; (b) applying a primer to the substrate to provide a primed substrate; (c) applying a base coat to the primed substrate, wherein the base coat comprises a first fluoropolymer component; and (d) applying a top coat to the base coat, wherein the top coat comprises a clear acrylic coating and a second fluoropolymer component.

* * * * *